United States Patent [19]

Clarke et al.

[11] Patent Number: 4,630,450

[45] Date of Patent: Dec. 23, 1986

[54] EXPENDABLE REFRIGERATION CONTROL

[75] Inventors: Kenneth J. Clarke, Senneville; Gordon Lamb, Dorval, both of Canada

[73] Assignee: Conterm International Terminals, Inc., Pointe Claire, Canada

[21] Appl. No.: 730,826

[22] Filed: May 6, 1985

[51] Int. Cl.[4] ..... F25B 41/04

[52] U.S. Cl. ..... 62/222; 62/231; 137/624.14; 236/80 R

[58] Field of Search ..... 62/55, 231, 514 R, 384, 62/222; 236/80 R; 137/624.14, 821

[56] References Cited

U.S. PATENT DOCUMENTS

| | | | |
|---|---|---|---|
| 3,508,565 | 4/1970 | Strantz | 137/821 |
| 3,942,518 | 3/1976 | Tenteris et al. | 137/624.14 |
| 4,041,725 | 8/1977 | Garside | 62/514 R |
| 4,513,582 | 4/1985 | Garside | 62/231 |

FOREIGN PATENT DOCUMENTS 1161654 2/1984 Canada .

*Primary Examiner*—Ronald C. Capossela

*Attorney, Agent, or Firm*—Swabey, Mitchell, Houle, Marcoux & Sher

[57] ABSTRACT

An apparatus for controlling the opening and closing operation of a liquid flow valve dispensing fluid fed thereto from a reservoir, using the inherent gas pressure from the reservoir, comprising in combination (a) an actuator means operably connected to the flow valve for opening and closing the same; and (b) control means for controlling the operation of the actuator means, the control means comprising circuitry having pneumatic linear timer means and pneumatic control valve means operably connected one to another and to the actuator means. Also disclosed is a method of controlling the opening and/or closing operation of a liquid flow valve dispensing liquid fed thereto from a reservoir, using the inherent gas pressure from the reservoir.

9 Claims, 4 Drawing Figures

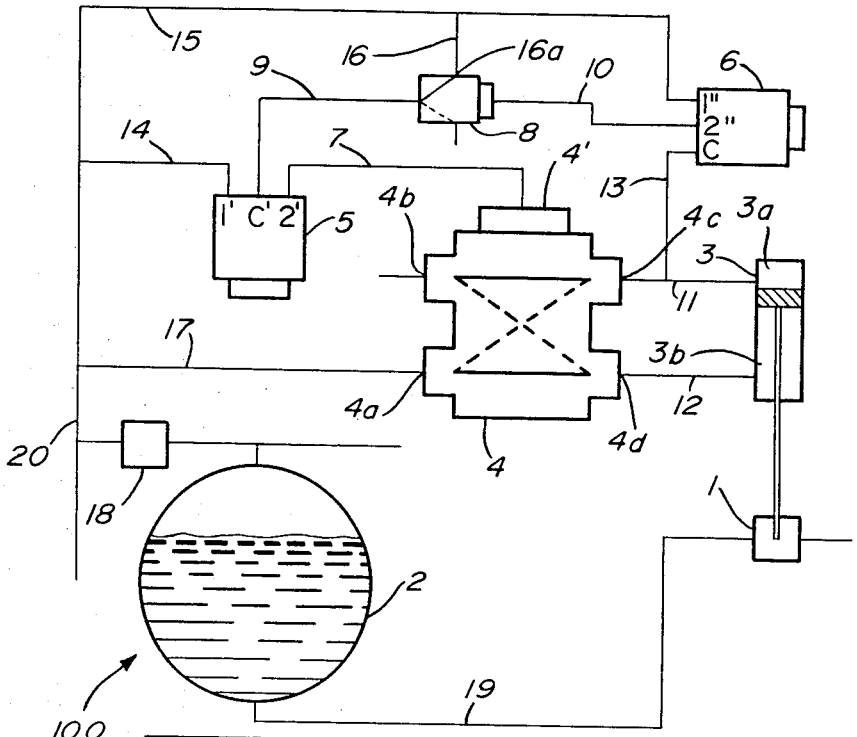
FIG. 1
FIG. 2
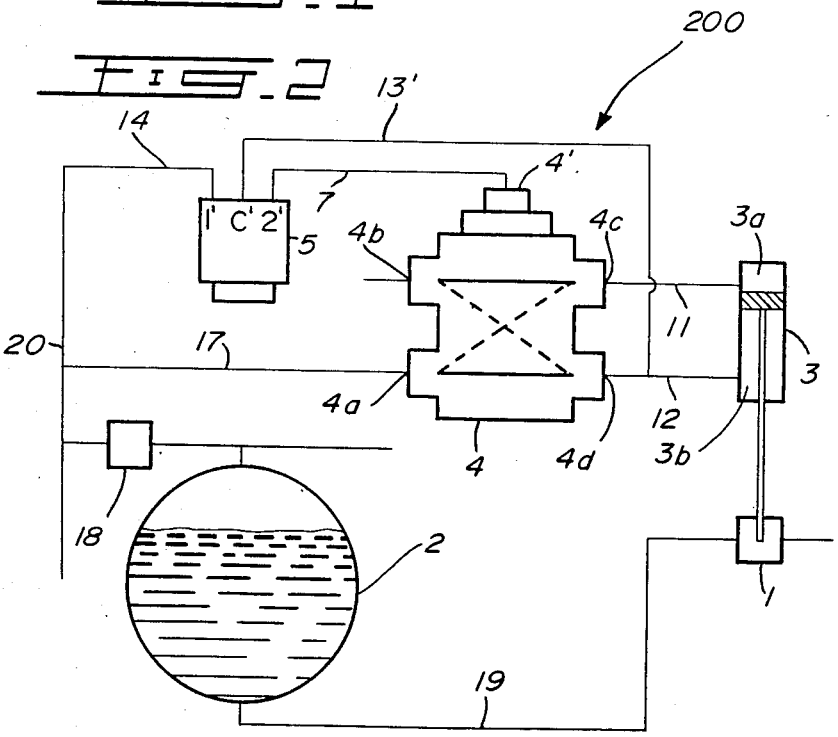

EXPENDABLE REFRIGERATION CONTROL

BACKGROUND OF THE INVENTION (a) Field of Invention

The present invention relates to an apparatus and method for controlling the opening and/or closing operation of a liquid valve dispensing liquid fed thereto from a reservoir, using the inherent gas pressure from the reservoir.

The present invention particularly relates to a control system for a pressurized liquid gas reservoir incorporated in an expandable refrigerant refrigeration system. In such instance, the invention provides a control system which utilizes gas from the reservoir to control the flow of liquid from the reservoir in a series of cyclic injections.

(b) Description of Prior Art

The use of the reservoir gas as a control media is well known as are cyclic control sequences used to achieve "pulsed" refrigerant injections. Applicant's U.S. Pat. No. 4,041,725 dated Aug. 16, 1977, discloses one method which makes use of two pressure actuated three-way valves, connected by gas lines damped by restrictors, such that the output of one addresses the actuation of the other to create a rhythmic assymetrical oscillation which results in one "pulsed" injection of refrigerant for each full cycle of the control system. Applicant's Canadian Pat. No. 1,161,654 dated Feb. 2, 1984, discloses further apparatus and methods which utilize at least one pressure operated oscillating pulse generator unit and a counting means operably connected to count the oscillations.

The aforementioned prior art invention per U.S. Pat. No. 4,041,725, in practical application, has proved to have but limited facility to vary the ratios of "on" to "off" timing. It has been found for instance, the adjustment of one restrictor affects both the "on" and the "off" durations and a normal maximum differential between the two cannot safely exceed a 5:1 ratio. Nor can the overall duration of a complete cycle be extended beyond about two minutes, without incurring the risk of hysteresis in the valve with consequential failure of the control function.

Working at or near the aforementioned limits of adjustment, requires a delicate, skilled, touch. Field calibration by unskilled operators is deemed all but impossible.

Although the control disclosed in U.S. Pat. No. 4,041,725 has a proven value when used in series with a temperature controller, by providing an extended response time so as to allow the temperature sensor a greater time to react to changed conditions and so avoid an overshoot (of refrigerant injected), it is deemed to have little practical worth as a selectable metering means.

A second problem and one common to most if not all controls used with expendable refrigeration systems, arises whenever the control set point is set, for whatever reason, below the existing cargo temperature. In these circumstances, the control, in seeking to reduce temperatures to that set point and needing to reduce a large cargo mass to achieve that purpose, will commence and continue to inject refrigerant at its maximum rated capacity. Generally, this action will rapidly exhaust the available refrigerant leaving the product without means of refrigeration for the balance of the journey.

In the case of the aforementioned prior art invention per Canadian Pat. No. 1,161,654, it too in practical application, has proved to have but limited facility to vary the ratios of "on" to "off" timing, mainly because of bias in the resetting.

SUMMARY OF THE INVENTION

It is therefore a prime aim of the present invention to overcome the aforementioned problems.

In one aspect of the present invention, there is provided an apparatus for controlling the opening and closing operation of a liquid flow valve dispensing fluid fed thereto from a reservoir, using the inherent gas pressure from the reservoir, comprising in combination (a) an actuator means operably connected to the flow valve for opening and closing the same; and (b) control means for controlling the operation of the actuator means, the control means comprising circuitry having pneumatic linear timer means and pneumatic control valve means operably connected one to another and to the actuator means.

In a further aspect of the present invention, there is provided an apparatus for controlling the opening and closing operation of a liquid flow valve dispensing liquid fed thereto from a reservoir, using the inherent gas pressure from the reservoir, comprising in combination (a) an actuator operably connected to the flow valve for opening and closing the same; (b) valve means operably connected to the actuator for activating the same; and (c) control means for controlling the operation of the valve means, the control means comprising circuitry having at least one pneumatic linear timer valve.

According to the further broad aspect of the present invention there is provided an apparatus for controlling the opening and closing operation of a liquid flow valve for dispensing fluid fed thereto from a reservoir and using the inherent gas pressure from the reservoir. The control apparatus comprises in combination a pneumatic piston operated actuator device having a piston side and a rod side. The rod side is operably connected to the flow valve for opening and closing same. Control means is also provided for controlling the operation of the pneumatic actuator device and has a first pneumatic linear timer valve having a cycle time delay and connected to a gas pressure line of the reservoir. A second pneumatic linear timer valve is also provided and has an injection time delay, and is also connected to the gas pressure line of the reservoir. The first and second pneumatic linear timer valves are interconnected through a control valve. A pneumatic actuator control valve is connected to the gas pressure line of the reservoir and to the piston side and rod side of the actuator device for controlling the operation of the actuator device. The first pneumatic linear timer valve is connected to the actuator control valve to operate same after the cycle time delay to cause the actuator device to operate the liquid flow valve to dispense fluid from the reservoir and to further actuate the second pneumatic linear device to initiate the injection time delay and open condition of said liquid flow valve where, upon completion of same, the first pneumatic linear time valve receives a signal through the control valve to deactivate the actuator control valve and the actuator device to close the liquid flow valve to end liquid flow from the reservoir and to recommence a further cycle time delay of the first pneumatic linear timer valve.

According to a further broad aspect of the present invention, there is provided a method of opening and closing a liquid flow valve dispensing liquid fed thereto from a reservoir and using the inherent gas pressure from the reservoir. The method comprises the the steps of connecting a first and second time delay valve to a gas pressure line of the reservoir. A control valve is also connected to the first and second time delay valves and to the gas pressure line. An actuator control valve is connected to an actuator device to control the actuator device and the position of the liquid flow valve connected to a fluid line of the reservoir. A time delay cycle is initiated by the first time delay valve to maintain the liquid flow valve closed. The actuator device is operated by pressure from the gas pressure line through the first time delay valve and the actuator control valve after termination of the time delay cycle. Simultaneously, the second time delay valve is operated to initiate an injection time cycle where, upon completion the actuator device reverses the position of the liquid flow valve to interrupt the flow of fluid from the reservoir.

BRIEF DESCRIPTION OF THE DRAWINGS

The invention is illustrated by way of example in the accompanying drawings wherein:

FIG. 1 is a schematic diagram illustrating a first embodiment according to the present invention, showing a control system, such as for a refrigeration unit, including a pressurized liquified gas reservoir and a piston actuated flow valve, for releasing the liquified gas;

FIG. 2 is a schematic diagram illustrating a second embodiment according to the present invention;

DESCRIPTION OF PREFERRED EMBODIMENTS

Figure 3:
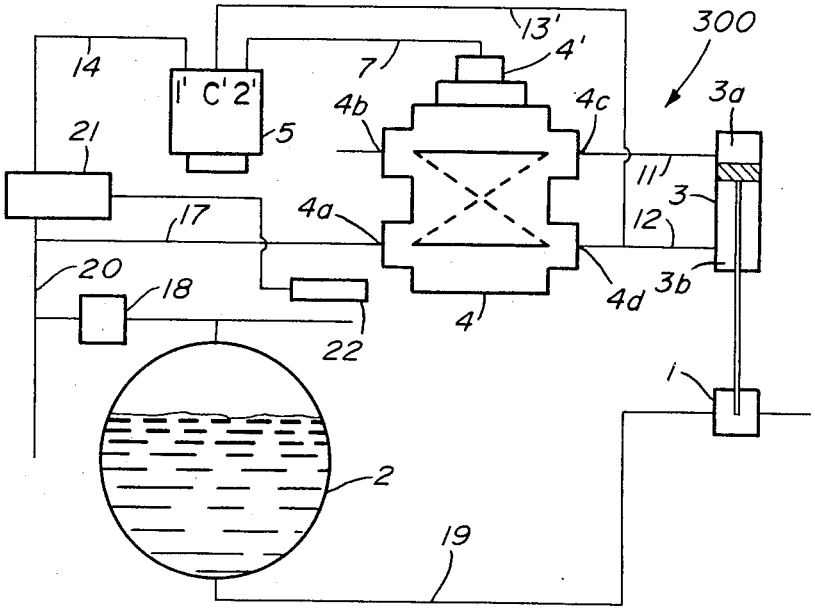
FIG. 3 is a schematic diagram illustrating a third embodiment according to the present invention.

Referring now in detail to the drawings:

In FIG. 1, there is shown an apparatus 100 for controlling the opening and closing operation of the liquid flow valve 1 dispensing fluid fed thereto from a reservoir 2, using the inherent gas pressure from reservoir 2. Apparatus 100 includes an actuator means 3 operably connected to flow valve 1 for opening and closing the same.

Apparatus 100 further includes a control means for controlling the operation of actuator means 3, the control means comprising circuitry having pneumatic linear timer means and pneumatic control valve means operably connected one to another and to actuator means 3.

The circuitry includes a pneumatic 4-way valve 4 and actuator means 3 comprises a pneumatic device having a piston side 3*a* and a rod side 3*b*. The pneumatic linear timer means comprises first and second pneumatic linear timer valves 5 and 6. First timer valve 5 is connected via a line means 7 from port 2' to 4-way valve 4. The control valve means, which is designated 8, and comprises a 3-way N.O. pneumatic valve, is connected via line means 9 and 10 respectively to timer valves 5 and 6 respectively at ports C' and 2''. 4-way valve 4 is connected via line means 11 and 12 respectively to actuator means piston side 3*a* and rod side 3*b* from respective ports 4*c* and 4*d* thereof. Timer valve 6 is connected via line means 13 to line means 11. Timer valves 5 and 6, control valve means 8 and 4-way valve 4 are all connected via respectively line means 14, 15, 16 and 17 to reservoir 2 respectively from ports 1', 1'', 16*a* and 4*a*. A reducing valve means 18 is included in the circuitry, as shown, upstream of reservoir 2. A fluid line means 19 extends from reservoir 2 and is operably connected to flow valve 1.

In the case of the particular preferred embodiments disclosed, timer valve 5 comprises a pneumatic timer manufactured by Kuhnke under Catalogue No. PT 35 E and having an operative time range setting of between 20–200 seconds and timer valve 6 comprises a pneumatic timer manufactured by Kuhnke under Catalogue No. PT 35 C and having an operative time range setting of between 1.5–15 seconds. The 4-way valve 4 comprises a pneumatic valve manufactured by Norgren, under Catalogue No. F101 2B-00A1. The operator mechanism or timer head when used in conjunction with the latter valve comprises Catalogue No. 01-TDO manufactured by Norgren. The control valve means 8 comprises a 3-way pneumatic valve manufactured by Norgren under Catalogue No. T70DA00-TSi-TA6. It is to be understood that other suitable commercially available items may be used in place of the ones mentioned.

Referring now to the operation of apparatus 100. Gas from reservoir 2 is supplied through the reducing valve 18, to line 20 and to branch line 17 through the 4-way valve 4 by way of port 4*a*, through port 4*d* supplied through line 12 to the lower chamber 3*b* of the double acting piston actuator 3. This pressure holds the piston back and in turn holds the liquid line valve 1 in the closed position. Both pneumatic timers 6 and 5 are continuously fed pressure signals through their respective branch lines 15 and 14, to port 1' on each valve. Branch line 15 also supplies pressure to the 3-way N.O. pneumatic valve 8 by means of branch 16. This signal through valve 8 also energizes port C' through branch 9 on timing valve 5 (off cycle) and initiates the long time delay. At the end of the time delay on valve 5, the internal mechanism of valve 5 opens the supply from inlet 1' on valve 5 to outlet 2' on valve 5. This signal is sent to the N.O. 4-way valve 4 through branch 7 thereby switching valve 4 and allowing the stored pressure in the lower chamber of the piston actuator 3 to be vented by way of line 12 through port 4*d* to port 4*b* to atmosphere. This signal also allows the pressure in line 17 to pass through port 4*a* to port 4*c* along line 11 to the upper chamber of the piston actuator 3, which energizes liquid line valve 1 and port C on the timing valve 6 (injection on time) and injection commences. At the end of the injection on cycle, the signal pressure in port 1'' of valve 6 is allowed to pass to port 2'' (through internal mechanism of valve 6) and through line 10 to the 3-way N.O. valve 8. This signal allows line 9 (port C' of timing valve 5) to vent through valve 8 to atmosphere. This loss of signal to port C' on timing valve 5 deactivates the signal through line 7 and switches the 4-way N.O. valve 4 thereby venting port C of timing valve 6 and the upper chamber 3*a* of piston actuator 3 through line 13 and 11 respectively by means of port 4*b* on the 4-way N.O. valve 4. Also, upon deactivation of valve 4 the pressure in line 17 is allowed to pass into the lower chamber 3*b* of piston actuator 3 thereby closing the liquid line valve 1 hence ending the injection on cycle (The operation of pressurizing the lower chamber of piston actuator 3 and venting both port C of valve 6 and the upper chamber 3*a* of piston actuator 3 happen simultaneously). Once the signal in port C of valve 6 is lost, the signal from port 2" of valve 6, which, through line 10 activates valve 8, is also lost, and this action deactivates valve 8, allowing it to go back to its N.O. position, and allowing pressure through line 16 to pass through line 9 and reactivate port C' of valve 5 thereby commencing the cycle again.

In FIG. 2 there is shown apparatus 200 for controlling the opening and closing operation of a liquid flow valve 1 dispensing fluid thereto from a reservoir 2 using the inherent gas pressure from reservoir 2.

Apparatus 200 includes an actuator means 3 operably connected to flow valve 1 for opening and closing the same.

Apparatus 200 further includes a control means for controlling the operation of actuator means 3, the control means comprising circuitry having pneumatic linear timer means and pneumatic control valve means operably connected one to another and to actuator means 3.

The circuitry includes a pneumatic 4-way valve 4 fitted with an operator mechanism 4'. Actuator means 3 comprises a pneumatic device having a piston side 3*a* and a rod side 3*b*. The pneumatic linear timer means comprises a pneumatic linear timer valve 5. Timer valve 5 is connected via a line means 7 from port 2' to operator mechanism 4' of 4-way valve 4. 4-Way valve 4 is connected via line means 11 and 12 respectively to actuator means piston side 3*a* and rod side 3*b* from respective ports 4*c* and 4*d* thereof. Timer valve 5 is connected via line means 13' to line means 12 from port C' thereof. Timer valve 5 and 4-way valve 4 are connected via respective line means 14 and 17 to reservoir 2 respectively from ports 1' and 4*a*. The reducing valve means 18 is included in the circuitry as shown, upstream of reservoir 2. A fluid line means 19 extends from reservoir 2 and is operatively connected to flow valve 1.

Referring now to the operation of apparatus 200.

Gas from reservoir 2 is supplied through the reducing valve 18 to line 20, branch line 17 and branch line 14. This pressure is allowed by means of branch line 17 to pass through the 4-way N.O. valve 4 by means of port 4*a* through port 4*d*, along line 12 to the lower chamber 3*b* of the double acting piston actuator 3. This pressure holds the piston back, and in turn holds the liquid line valve 1 in the closed position. This pressure (which is now existing by way of valve 4) in line 12 also allows pressure by means of branch line 13 to actuate port C' of pneumatic timer 5 (off cycle) and thereby actuates the long time delay cycle. At the end of the long time delay on valve 5, the internal mechanism of valve 5 opens the supply pressure of the inlet port 1' on valve 5 and allows it to pass through outlet port 2' on valve 5. This signal from port 2' allows pressure to activate the time delay head or operator mechanism 4' (injection on) of valve 5. This time delay head replaces valves 8 and 6 of FIG. 1. Once activated this head will switch valve 5 into the closed position for a pre-set duration, allowing pressure in line 17 to pass by way of port 4*a* diagonally through port 4*c* by way of line 11 into the upper chamber of piston actuator 3. This action of the time delay head 4' also allows the pressurized lower chamber of piston actuator 3 to vent to atmosphere by way of line 12 through port 4*d* out diagonally through port 4*b*. Once the upper chamber 3*a* is pressurized and the lower chamber 3*b* depressurized, the piston of actuator 3 is allowed to move down thereby activating liquid line valve 1 and allowing a flow of liquid to be injected into the space by way of line 19. At the end of the signal from the time delay head 4', the 4-way N.O. valve 4 is allowed to return to its original position and pressurize the lower chamber 3*b* of the piston actuator 3 thereby closing liquid line valve 1 hence stopping injection. Simultaneously (it can be seen from FIG. 2) as pressure is allowed to flow into the lower chamber 3*b* of actuator 3 by means of line 12 (supplied by line 17) pressure is allowed to flow into line 13 and pressurize port C' of valve 5 thereby starting the cycle once again.

In FIG. 3, there is shown apparatus 300 for controlling the opening and closing operation of a liquid flow valve 1 dispensing fluid fed thereto from a reservoir 2 using the inherent gas pressure from reservoir 2.

Apparatus 300 includes an actuator means 3 operably connected to flow valve 1 for opening and closing the same.

Apparatus 300 further includes a control means for controlling the operation of actuator means 3, the control means comprising circuitry having pneumatic linear timer means and pneumatic control valve means operably connected one to another and to actuator means 3.

The circuitry includes a pneumatic 4-way valve 4 fitted with an operator mechanism 4'. Actuator means 3 comprises a pneumatic device having a piston side 3*a* and a rod side 3*b*. The pneumatic linear timer means comprises a pneumatic linear timer valve 5. Timer valve 5 is connected via a line means 7 from port 2' to operate a mechanism 4' of 4-way valve 4. 4-Way valve 4 is connected via line means 11 and 12 respectively to actuator means piston side 3*a* and rod side 3*b* from respective ports 4*c* and 4*d* thereof. Timer valve 5 is connected via line means 13' to line means 12 from port C' thereof. Timer valve 5 and 4-way valve 4 are connected via respective line means 14 and 17 to reservoir 2 respectively, from ports 1' and 4*a*. A reducing valve means is included in the circuitry as shown upstream of reservoir 2. A fluid line means 19 extends from reservoir 2 and is operably connected to flow valve 1.

Apparatus 300 also includes a temperature controller unit 21 having a transmitter/temperature sensor 22. It will be noted line means 17 connects into line means 20 upstream of reservoir 2. Temperature controller unit 21 is operably connected in line means 20 intermediate timer valve 5 and the connection of line means 17 into line means 20.

In the case of the preferred embodiment disclosed, the temperature controller is a two position temperature controller manufactured by Partlow under Catalogue No. LFNA 217-KLSY-220-55.

Referring now to the operation of apparatus 300. Gas from reservoir 2 is supplied through the reducing valve 18 to line 20 branch line 17 and to the temperature responsive controller unit 21. This pressure is allowed by means of branch line 17 to pass through the 4-way N.O. valve 4 by way of port 4*a* through port 4*d* and along line 12 to the lower chamber 3*b* of the double acting piston actuator 3. This pressure in the lower chamber 3*b* holds the piston back, and in turn holds liquid line valve 1 in the closed position. The pressure in line 12 allows a signal pressure to pass through line 13' and supply pressure to port C' on pneumatic timing valve 5 (injection off cycle). No pressure exists at port 1' on valve 5 until the signal transmitter/temperature sensor 22 (which is connected to the temperature controller unit 21) senses a cooling requirement in the controlled temperature zone. Once the transmitter/temperature sensor 22 senses a requirement for cooling, it transmits a signal to controller 21, and controller 21 allows pressure to pass by means of line 20 through the controller unit 21 by way of branch line 14 to port 1' on pneumatic timing valve 5. When a signal exists at both port 1' and port C' on valve 5, the long time delay is activated and the complete system operates as explained in FIG. 2. Once the cooling requirements have been met, sensor 22 transmits a signal to controller 21 and the complete system is turned off until further cooling requirements are sensed.

Figure 4:
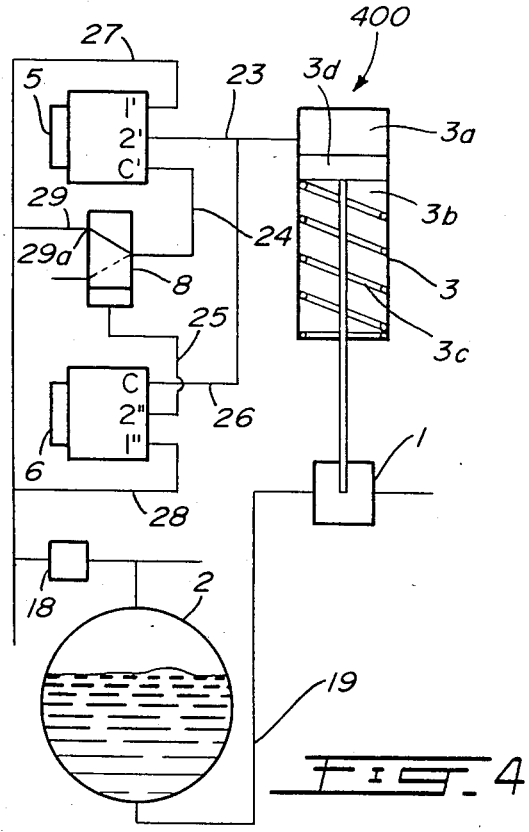
FIG. 4 is a schematic diagram illustrating a fourth embodiment according to the present invention.

In FIG. 4 there is shown apparatus 400 for controlling the opening and closing operation of a liquid flow valve 1 dispensing fluid fed thereto from a reservoir 2 using the inherent gas pressure from reservoir 2.

Apparatus 400 includes an actuator means 3 operably connected to flow valve 1 for opening and closing the same.

Apparatus 400 further includes a control means for controlling the operation of actuator means 3, the control means comprising circuitry having pneumatic linear timer means and pneumatic control valve means operatively connected one to another and to actuator means 3. The pneumatic linear timer means comprises first and second pneumatic linear timer valves denoted respectively 5 and 6. Actuator means 3 comprises a pneumatic device having a piston side **3*a* and a rod side 3*b* housing a compression spring means 3*c* which may comprise a spring or other suitable means including hydraulic and pneumatic means, biasing the piston 3*d* toward compressing gas in piston side 3*a*. The control valve means designated 8, comprises a 3-way N.O. pneumatic valve. Timer valve 5 is connected via line means 23 to actuator piston side 3*a* from port 2' thereof. Control valve means 8 is connected to timer valve 5 via line means 24 entering port C thereof. Timer valve 6 is connected to control valve means 8 via line means 25 from port 2'' thereof, and timer valve 6 is also connected to line means 23 via line means 26 from port C thereof. Timer valves 5 and 6 and control valve means 8 are connected via respectively line means 27, 28 and 29 to reservoir 2, respectively from ports 1', 1'' and 29*a*. A reducing valve means 18 is included in the circuitry as shown, upstream of reservoir 2. A fluid line means 19 extends from reservoir 2 and is operably connected to flow valve 1**.

Referring now to operation of apparatus 400. FIG. 4 shows the operation of the system in its simplest form. Line 20 is the gas supply line and line 19 is the liquid supply line. Gas pressure in line 20 is supplied through branch lines 28, 29 and 27, to the pneumatic timer 6 (injection on), the 3-way N.O. pneumatic valve 8 and the pneumatic timer 5 (injection off) respectively. Port C' of valve 5 is pressurized by a signal pressure in line 24 which exists by way of branch line 29 through valve 8. This signal pressure energizes valve 5 and commences the long time delay. At the end of said time delay, the internal mechanism allows gas pressure at inlet port 1' of valve 5 to pass through outlet port 2' of valve 5. Pressure from outlet port 2' passes by way of line 23 to the upper chamber of the piston actuator **3*a*, and is also allowed to pass through branch line 26 to port C of pneumatic timing valve 6, energizing valve 6 (injection on time). Pressure in the upper chamber of actuator 3*a* pushes the piston down against the actuator spring 3*c* of actuator 3 and energizes liquid line valve 1 allowing liquid to pass from line 19 through liquid line valve 1 and be injected into the refrigerated space. At the end of the injection time, valve 6, by means of an internal mechanism allows gas to pass from inlet port 1'' on valve 6 to outlet port 2''. This pressure passes through by way of line 25 and actuates valve 8 thereby venting the pressure in line 24 and deactivating valve 5 and also allowing actuator spring 3*c* to lift and hold liquid line valve 1 in the off position. Once this has been achieved, the signal pressures in line 23 and branch line 26 have been vented, thereby deactivating valve 6 (since no pressure exists now at port C on valve 6). Now, valve 8 resets to its original position, allowing pressure to pass from line 29 into line 24, thereby energizing valve 5** by way of port C, and the cycle once again repeates itself.

Pneumatic timing valves 5 and 6 combine a field-proven pneumatic timing mechanism with a floating spool valve assembly to provide a wide range of adjustable time control for fluid power systems. The timing assembly, which operates independently of the control pressure, offers nine discrete ranges from 0.5 seconds to 60 minutes, adjustable by means of time-calibrated dials. Timing action is initiated by a motor diaphragm operated by pressures of 5 to 140 P.S.I.G.

The timing head has been used successfully in electropneumatic timing relays for a number of years. This device produces calibrated time delays by trapping atmospheric air in a timing chamber. When the timing mechanism is released, a precision timing spring pushes a diaphragm upward, and expels the air from the timing chamber to atmosphere through a long, circular capillary groove in an optically flat timing disc.

When the timing diaphragm and its timing stem have moved far enough, they actuate a snap action trip and move the valve spool.

Turning the time adjustment knob provided changes the effect of length of the capillary groove, thus changing its resistance to air flow. Adjustment is virtually linear, unlike needles and other devices which change the area available for flow. Timing is completely independent of the air pressure applied to the timer.

The motor diaphragm actuates the timer unlatching mechanism. It is a sealed diaphragm chamber, and actuates successfully at all pressures from 5 to 140 P.S.I.G.

The output valve is a packless spool-floating sleeve valve. It is a 3-port multi-purpose 3-way and maybe used as a normally opened 3-way, a normally closed 3-way, a selector, or a diverter.

In the case of FIG. 4 preferred embodiment, a control panel may be utilized for mounting timing valves 5 and 6 to provide the two operating types providing both delay on application of pressure to the motor diaphragm (on-delay), and removal of pressure (off-delay). Operation of such arrangement is now explained, having reference to FIG. 4. Re: (on-delay) valve 5. Time delay after energizing, immediate reset upon de-energizing.

Timing diaphragm, motor diaphragm and valve spool are in the down position. Application of a pilot signal to control port C moves the motor diaphragm up and compresses the reset spring. Now the timing spring can move the spindle upward at a rate controlled by the air escaping from the timing chamber. Eventually all lost motion in the slop link is taken up, and when the force of the timing spring overcomes a snap action latch, the valve spool snaps up (on position).

When the control signal is removed, the reset spring forces the motor diaphragm, the spindle, and the valve spool down immediately (off position).

It is within the ambit of the present invention to cover any obvious modifications of the examples of the preferred embodiment described herein, provided such modifications fall within the scope of the appended claims.

We claim:

1. In a refrigeration system an apparatus for controlling the opening and closing operation of a liquid flow valve for dispensing fluid fed thereto from a reservoir and using the inherent gas pressure from the reservoir, comprising in combination:

(a) a pneumatic piston operated actuator device having a piston side and a rod side, said rod side being operably connected to said flow valve for opening and closing the same; and (b) control means for controlling the operation of said pneumatic actuator device, said control means having a first pneumatic linear timer valve having a cycle time delay and connected to a gas pressure line of said reservoir, a second pneumatic linear timer valve having an injection time delay and also connected to said gas pressure line of said reservoir, said first and second pneumatic linear timer valves being interconnected through a control valve, a pneumatic actuator control valve connected to said gas pressure line of said reservoir and to said piston side and rod side of said actuator device for controlling the operation of said actuator device, said first pneumatic linear timer valve being connected to said actuator control valve to operate same after said cycle time delay to cause said actuator device to operate said liquid flow valve to dispense fluid from said reservoir and to further actuate said second pneumatic linear device to initiate said injection time delay and open condition of said liquid flow valve where, upon completion, of same said first pneumatic linear timer valve receives a signal through said control valve to deactivate said actuator control valve and said actuator device to close said liquid flow valve to end liquid flow from said reservoir and to recommence a further cycle time delay of said first pneumatic linear timer valve.

2. An apparatus as defined in claim 1 wherein said second pneumatic linear timer is connected to said piston side of said actuator device to initiate said injection time delay upon the detection of gas pressure applied to said piston side by said actuator control valve and to deactivate said control valve upon the detection of loss of pressure at said piston side to thereby cause said first pneumatic linear timer to recommence said further cycle time delay.

3. An apparatus as defined in claim 2, wherein said rod side of said actuator device includes a compression spring means therein biasing said piston toward compression of gas in said piston side, and a reducing valve connected to said pressure line of said reservoir.

4. An apparatus as defined in claim 3 wherein said pneumatic actuator control valve is a pneumatic 4-way valve, said first timer valve being connected via a first line means to said 4-way valve, said control valve being connected via second and third line means respectively to said first timer valve and said second timer valve, said 4-way valve is connected via fourth and fifth line means respectively to said actuator device, piston side and rod side, said second timer valve is connected via sixth line means to said fourth line means; said first and second timer valves, said control valve means and 4-way valve are connected via respectively seventh, eighth, ninth and tenth line means to said reservoir upstream of said reducing valve, and said reservoir including fluid line means extending therefrom and operably connected to said flow valve.

5. An apparatus as defined in claim 2, including a temperature controller unit having a transmitter/temperature sensor connected to said gas pressure line, upstream of said reservoir, said temperature controller unit being operably connected to said first timer valve.

6. An apparatus as defined in claim 2, wherein said second pneumatic linear timer valve comprises a pneumatic timer adapted to be set in the operating range of 1.5 to 15 seconds.

7. An apparatus as defined in claim 2, wherein said first pneumatic linear timer valve comprises a pneumatic timer adapted to be set in the operating range of 20 to 200 seconds.

8. In a refrigeration system, a method of opening and closing a liquid flow valve dispensing liquid fed thereto from a reservoir and using the inherent gas pressure from said reservoir, said method comprising the steps of:

(i) connecting a first and second time delay valve to a gas pressure line of said reservoir;

(ii) connecting a control valve to said first and second time delay valves and to said gas pressure line;

(iii) connecting an actuator control valve to an actuator device to control said actuator device and the position of said liquid flow valve connected to a fluid line of said reservoir;

(iv) initiating a time delay cycle by said first time delay valve to maintain said liquid flow valve closed;

(v) operating said actuator device by pressure from said gas pressure line through said first time delay valve and said actuator control valve after termination of said time delay cycle; and (vi) simultaneously operating said second time delay valve to initiate an injection time cycle where, upon completion, said actuator device reverses the position of said liquid flow valve to interrupt the flow of fluid from said reservoir.

9. A method as claimed in claim 8 wherein there is further provided the step of (vii) automatically reactivating said first time delay valve through said second time delay valve and said control valve upon detection of said reversal of the position of said liquid flow valve.

* * * * *